US010309362B2

(12) United States Patent
Behringer et al.

(10) Patent No.: US 10,309,362 B2
(45) Date of Patent: Jun. 4, 2019

(54) STARTER DEVICE FOR AN INTERNAL COMBUSTION ENGINE AND HANDHELD WORK APPARATUS HAVING AN INTERNAL COMBUSTION ENGINE AND SAID STARTER DEVICE

(71) Applicant: Andreas Stihl AG & Co. KG, Waiblingen (DE)

(72) Inventors: Patrick Behringer, Ostfildern (DE); Sven Keller, Berglen (DE); Werner Vonderau, Althuette (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 671 days.

(21) Appl. No.: 15/011,258

(22) Filed: Jan. 29, 2016

(65) Prior Publication Data

US 2016/0222937 A1 Aug. 4, 2016

(30) Foreign Application Priority Data

Jan. 29, 2015 (DE) ..... 10 2015 001 119

(51) Int. Cl.

| | |
|---|---|
| ***F02N 1/00*** | (2006.01) |
| ***F02N 3/02*** | (2006.01) |
| ***F02B 63/02*** | (2006.01) |
| *F02N 5/02* | (2006.01) |
| *F02B 75/02* | (2006.01) |

(52) U.S. Cl.

CPC ..... *F02N 3/02* (2013.01); *F02B 63/02* (2013.01); *F02B 2075/025* (2013.01); *F02D 2400/06* (2013.01); *F02N 5/02* (2013.01)

(58) Field of Classification Search

CPC . F02N 3/02; F02N 5/02; F02N 15/027; F16D 41/206; F16D 1/06

USPC ..... 123/185.3, 185.4; 192/41 S

See application file for complete search history.

(56) References Cited

U.S. PATENT DOCUMENTS

| | | | | |
|---|---|---|---|---|
| 1,932,000 | A * | 10/1933 | Starkey | F16D 41/206 192/107 T |
| 1,953,370 | A * | 4/1934 | Starkey | F16D 41/206 192/41 S |
| 2,043,152 | A * | 6/1936 | Cook | F16F 1/042 267/155 |
| 7,093,577 | B2 * | 8/2006 | Tohyama | F02N 3/02 123/185.3 |

(Continued)

FOREIGN PATENT DOCUMENTS

| | | |
|---|---|---|
| EP | 1 312 798 A2 | 5/2003 |
| EP | 1484499 A2 | 12/2004 |
| EP | 1712779 A2 | 10/2006 |

*Primary Examiner* — Marguerite J McMahon
*Assistant Examiner* — James J Kim
(74) *Attorney, Agent, or Firm* — Walter Ottesen, P.A.

(57) ABSTRACT

A starter device for an internal combustion engine has an entrainer for coupling to the engine. The entrainer and an actuator of the starter device are mounted rotatably about a rotational axis. A damper spring is arranged between and operatively connects the entrainer and the actuator to each other. The starter device has at least one stud, on whose outer periphery the damper spring is mounted. The damper spring is a hinge spring wound from a spring wire. The cross section of the spring wire is rounded on the inner side of the spring wire. At least a portion of the cross section runs linearly on the outer side of the spring wire.

16 Claims, 4 Drawing Sheets

(56) References Cited

U.S. PATENT DOCUMENTS

| | | | | |
|---|---|---|---|---|
| 7,658,176 | B2 | 2/2010 | Fattorusso et al. | |
| 7,963,266 | B2 * | 6/2011 | Kapinsky | F02N 5/02 123/185.14 |
| 2006/0070596 | A1 * | 4/2006 | Horikoshi | F02N 3/02 123/185.3 |
| 2008/0196685 | A1 * | 8/2008 | Fattorusso | F02N 3/02 123/185.3 |
| 2012/0199091 | A1 * | 8/2012 | Bohling | F02N 3/02 123/185.3 |

* cited by examiner

STARTER DEVICE FOR AN INTERNAL COMBUSTION ENGINE AND HANDHELD WORK APPARATUS HAVING AN INTERNAL COMBUSTION ENGINE AND SAID STARTER DEVICE

CROSS REFERENCE TO RELATED APPLICATION

This application claims priority of German patent application no. 10 2015 001 119.7, filed Jan. 29, 2015, the entire content of which is incorporated herein by reference.

FIELD OF THE INVENTION

The invention relates to a starter device for an internal combustion engine, having an actuating device which has to be set in rotation in order to start the internal combustion engine, and having an entrainer, which has at least one coupling device for coupling to a crankshaft of the internal combustion engine. The entrainer and the actuating device are mounted rotatably about a rotational axis and a damper spring is arranged in operative connection between the entrainer and the actuating device. The starter device has at least one stud, on whose outer periphery the damper spring is mounted. The damper spring is a hinge spring wound from a spring wire, wherein the spring wire, in a sectional plane containing the rotational axis, has a cross section, wherein the spring wire has in the cross section an axially measured width and a radially measured thickness. The spring wire has a radially inner-lying inner side and a radially outer-lying outer side. The cross section of the spring wire on the inner side of the spring wire is rounded. The invention further relates to a handheld work apparatus having an internal combustion engine and having a starter device.

BACKGROUND OF THE INVENTION

From EP 1 312 798 A2, a starter device for starting an internal combustion engine, which starter device has a damper spring, is known. One end of the damper spring is coupled to a rope pulley, and the other end of the damper spring is connected by a coupling device to a component that rotates with the crankshaft. The spring wire of the damper spring has a circular cross section.

It has been shown that starter devices having damper springs of circular cross section are comparatively insensitive to dirt. However, in the case of a circular cross-sectional area of the spring wire, the section modulus against bending is comparatively small, for instance, in relation to rectangular cross-sectional areas. In order to obtain the same spring constant, a damper spring of circular spring cross section must therefore have a larger outer diameter than a damper spring of rectangular cross section. A starter device having a damper spring of rectangular cross section is known, for instance, from U.S. Pat. No. 7,963,266.

SUMMARY OF THE INVENTION

It is an object of the invention to provide a starter device having a robust structure and a low weight. A further object of the invention is to provide a handheld work apparatus having an internal combustion engine and having a starter device.

With respect to the starter device, this object is achieved by a starter device wherein at least a portion of the cross section of the spring wire on the outer side of the spring wire runs straight. With respect to the handheld work apparatus, the object is achieved by a handheld work apparatus having an internal combustion engine and having a starter device for the internal combustion engine, wherein the starter device includes an actuating device, which has to be set in rotation in order to start the internal combustion engine, and an entrainer, wherein the entrainer has at least one coupling means for coupling to a crankshaft of the internal combustion engine. The entrainer and the actuating device are mounted rotatably about a rotational axis and a damper spring is arranged in operative connection between the entrainer and the actuating device. The starter device has at least one stud, on whose outer periphery the damper spring is mounted. The damper spring is a hinge spring wound from a spring wire, wherein the spring wire, in a sectional plane containing the rotational axis, has a cross section. The spring wire in cross section has an axially measured width and a radially measured thickness. The spring wire has a radially innermost inner side and a radially outermost outer side and the cross section of the spring wire on the inner side of the spring wire is rounded and at least a portion of the cross section on the outer side of the spring wire runs straight.

For the damper spring of the starter device, at least a portion of the cross section of the spring wire on the outer side of the spring wire runs straight. As a result of the straight portion, the section modulus of the spring wire against bending is increased. Accordingly, a damper spring of smaller outer diameter can be used than is the case with a damper spring having the same spring constant and a round spring wire cross section. Since the cross section of the spring wire on the inner side of the spring wire is rounded, the attachment and compaction of dirt deposits on the inner side of the spring wire, and on the outer side of the at least one stud on which the damper spring is mounted, is avoided. If the damper spring performs movements in the direction of the rotational axis, then dirt deposits on the inner side of the spring wire, which are disposed between the spring wire and the stud, are removed and not compacted on the outer periphery of the stud. Due to the rounding on the inner side of the spring wire, a softer performance of the starter device in relation to a damper spring of rectangular cross section is achieved if the damper spring is pulled to the limit on the stud since the rounded cross section on the inner side promotes a slight deformation of the stud, whereby a higher elasticity of the arrangement is achieved. Since the damper spring is rounded on its inner side, damaging of the stud by innermost edges of the damper spring is avoided.

The terms "radially" and "axially" relate to the rotational axis of entrainer and actuating device. The radially measured thickness is thus measured parallel to the rotational axis, and the radially measured thickness is measured perpendicular to the rotational axis.

Advantageously, the inner side of the spring wire runs in a continuous radius. Advantageously, the radius of the inner side of the spring wire is larger than half the width of the spring wire. As a result of the enlarged radius compared with a spring wire of circular cross section, the section modulus against bending is increased, whereby the overall weight of the arrangement can be reduced yet the damping characteristics remain the same.

Advantageously, the portion in which the outer side of the spring wire runs straight extends over at least 30% of the width of the spring wire. Advantageously, the straight portion on the outer side of the spring wire extends over at least 50%, particularly preferably over at least 70% of the width of the spring wire. Therefore, a large increase in section modulus in relation to a spring of round cross section, and at the same time a small outer diameter and thus a low weight of the damper spring, is achieved. In the straight portion, the outer side of the spring wire here advantageously runs parallel to the rotational axis of the starter device. The spring wire advantageously has transverse sides running transversely to the rotational axis, wherein at least a portion of the cross section on the transverse sides of the spring wire runs straight. The transverse sides are that region of the cross section which connects the inner side and the outer side. The straight portion on the transverse sides of the cross section of the spring wire here advantageously runs perpendicular to the rotational axis of the starter device. As a result of the straight portion on the transverse sides, a good mutual lateral contact of adjacent coils of the damper spring is obtained. Sliding of adjacent coils one over another, as can occur in the linear contact of helical springs of round cross section, is thereby largely avoided.

At the transition of the outer side into the transverse sides, the cross section of the spring wire advantageously extends with a radius. The radius with which the outer side passes into the transverse sides is here advantageously markedly smaller than the radius on the inner side. Advantageously, the radius with which the outer side passes into the transverse sides is smaller than one-quarter of the width of the spring wire. The thickness of the spring wire, measured perpendicular to the rotational axis, is advantageously at least as large as the width of the spring wire, measured parallel to the rotational axis. Particularly advantageously, the thickness of the spring wire is greater than the width. Hence, an increased section modulus against bending, and thus a higher spring constant, with the same outer diameter of the damper spring is achieved. The weight of the starter device can thereby be kept small overall.

Advantageously, the entrainer and the actuating device have respective studs and the damper spring is disposed on the outer periphery of the two studs. The damper spring advantageously has a substantially constant coil diameter. Accordingly, a simple structure and a uniform damping effect over the whole of the starter path are obtained. The coil diameter here corresponds to the outer diameter of the damper spring. Advantageously, the damper spring is held with a first, inwardly bent end on the actuating device and with a second, inwardly bent end on the entrainer. A simple, compact structure of the arrangement is thereby obtained. In order largely to avoid the accommodation of dirt deposits on the outer periphery of the stud, it is advantageously provided that at least one stud has depressions on its outer periphery. Dirt, which has collected between the damper spring and the stud, can pass into the depressions. In this way, the working of the starter device is not impeded by the dirt deposits.

A simple structure is obtained if the at least one coupling means on the entrainer includes a pivotably mounted pawl, which, for the coupling of the starter device to the crankshaft of the internal combustion engine, cooperates with a cam contour, wherein the cam contour is connected in a rotationally secure manner to the crankshaft so as to rotate therewith. The actuating device is advantageously a rope pulley, which is manually set in rotation by a starter rope or pull rope. Advantageously, a plurality of pawls, in particular two pawls, are provided.

The starter device is advantageously intended for a handheld work apparatus having an internal combustion engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
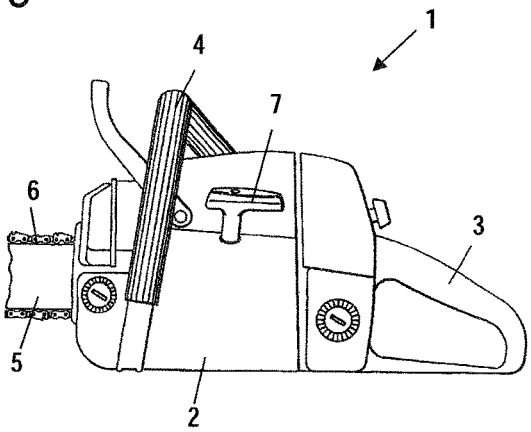
FIG. 1 is a schematic side elevation view of a motor-driven chain saw.

FIG. 1 shows a motor-driven chain saw as a work apparatus having a starter device. The motor-driven chain saw 1 is configured as a handheld, manually operated work apparatus and has a housing 2, on which a rear handle 3 and a bale handle 4 are mounted. The motor-driven chain saw 1 has a guide bar 5 on which a saw chain 6 is rotatingly driven. Projecting from the housing 2 is a starter handle 7 of a starter device 8 shown schematically in FIG. 2.

Figure 2:
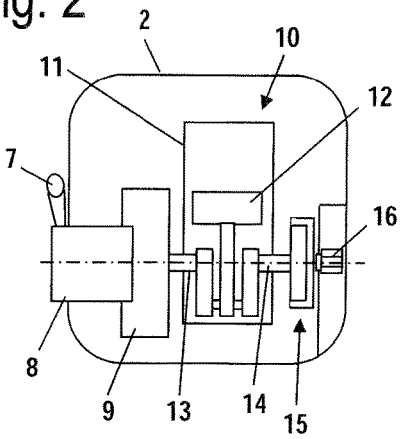
FIG. 2 is a schematic section view through the motor-driven chain saw of FIG. 1.

As shown by FIG. 2, an internal combustion engine 10 is mounted in the housing 2 of the motor-driven chain saw 1. The internal combustion engine 10 is advantageously configured as a two-stroke engine or as a mixture-lubricated four-stroke engine. The internal combustion engine 10 has a cylinder 11, in which a piston 12 is reciprocatingly mounted. The piston 12 drives a crankshaft 13 rotatingly about a rotational axis 14. In the embodiment shown, a fan wheel 9 is mounted on the crankshaft 13 and serves for moving cooling air for the internal combustion engine 10. The starter device 8 is in engagement with the fan wheel 9 during the starting process, as is explained in greater detail below. On that side of the internal combustion engine 10, which faces away from the fan wheel 9, is disposed a centrifugal clutch 15, which, when a structurally pregiven rotational speed is exceeded, connects the crankshaft 13 in a rotationally secure manner to a drive sprocket 16. The drive sprocket 16 serves to drive the saw chain 6 (FIG. 1).

Figure 3:
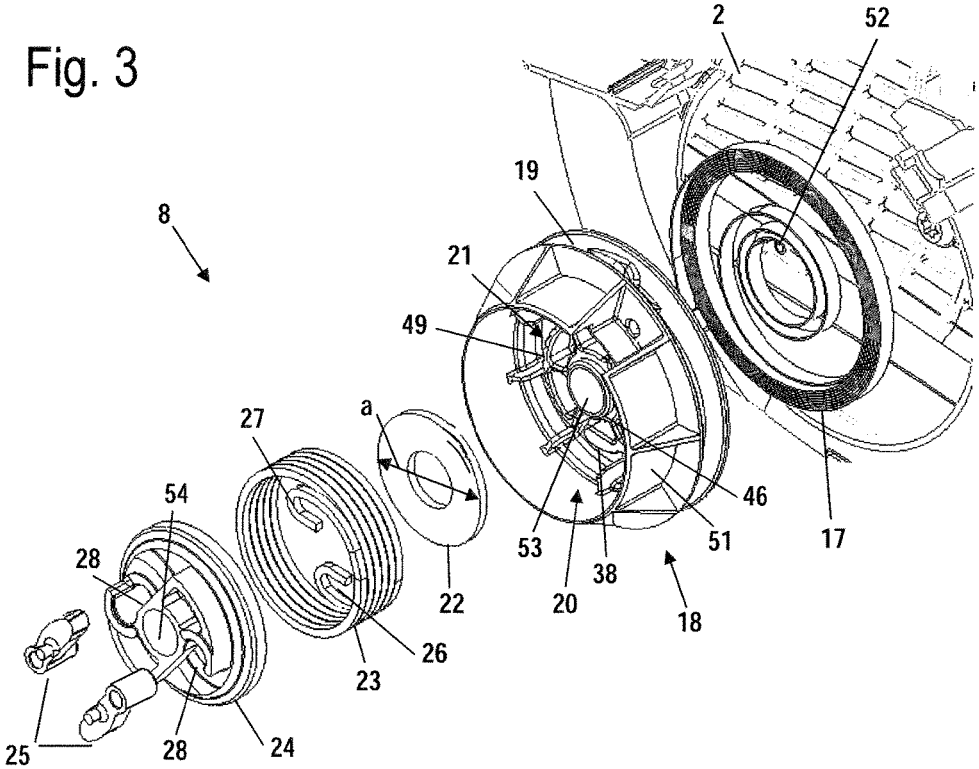
FIG. 3 is an exploded representation of the starter device of the motor-driven chain saw of FIGS. 1 and 2.

FIG. 3 shows the assembly of the starter device 8 in detail. The starter device 8 comprises a rope pulley 18, which is rotatably mounted in the housing 2 and is coupled by a return spring 17 to the housing 2. The return spring 17 has an inner end 52, which is held on the pulley 18. The outer end of the return spring 17 is held on the housing 2. The rope pulley 18 has a groove 19 for receiving a pull rope. On the side which projects into the housing 2, on the rope pulley 18 is formed a receiving space 20 into which projects a stud 21. The receiving space 20 is delimited by a roughly cylindrical peripheral wall 51. The rope pulley 18 has a central opening 53, which receives a bearing shaft (not shown in FIG. 3).

Figure 8:
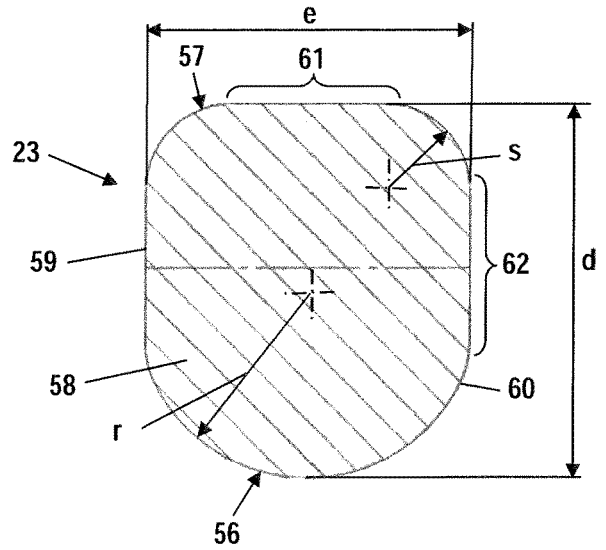
FIG. 8 is a section view showing the cross section of the spring wire of the damper spring of the starter device; and, FIGS. 9 and 10 are schematics of embodiments of the cross section of the spring wire of the damper spring.

As shown in FIG. 8, a damper spring 23, configured as a hinge spring, is provided. A first end 26 of damper spring 23 is suspended from a wall portion 38. The wall portion 38 is disposed on the base of the receiving space 20. A second end 27 of the damper spring 23 is connected to an entrainer 24. Between the rope pulley 18 and the entrainer 24 is disposed a disc 22 having an outer diameter (a). The entrainer 24 has an opening 54, which likewise receives the bearing shaft. On the entrainer 24, on the side facing away from the damper spring 23, are provided two receptacles 28 for accommodating pawls 25. The pawls 25 are pivotably mounted on the entrainer 24. The damper spring 23 is disposed largely in the receiving space 20. The receiving space 20 is largely closed off by the entrainer 24. Penetration of dirt deposits into the receiving space 20 during operation can hence be largely avoided.

Figure 4:
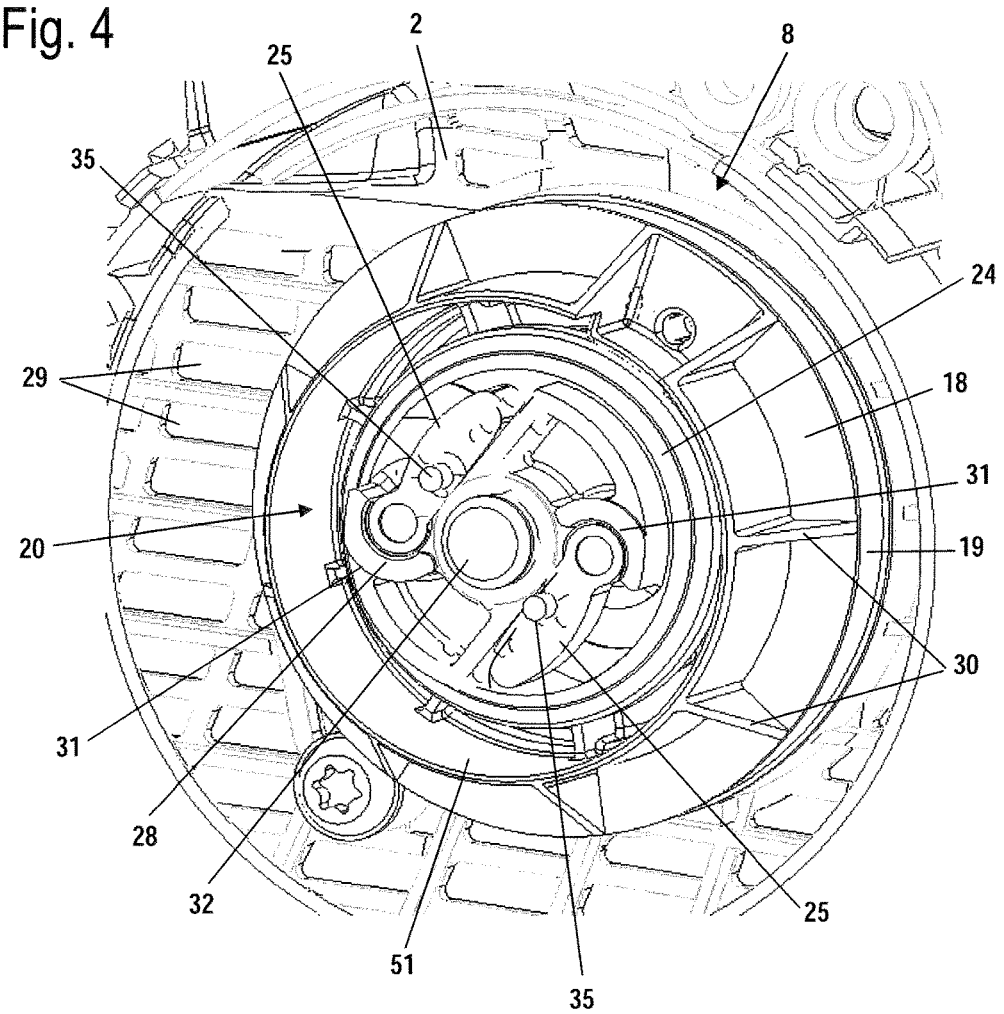
FIG. 4 is a perspective view of the starter device of FIG. 3.

FIG. 4 shows the arrangement of the pawls 25 on the entrainer 24 in detail. As shown by FIG. 4, a bearing shaft 32 projects through the entrainer 24. The entrainer 24 and the rope pulley 18 are rotatably mounted on the bearing shaft 32. The bearing shaft 32 is fixed on the housing 2. The pawls 25 have respective actuating lugs 35. In the region of their mounting, the pawls 25 are surrounded by wall portions 31 of the entrainer 24. Hence, the region of the mounting of the pawls 25 is protected from dirt. In addition, the wall portions 31 form a stop defining the outer pivoting position of the pawls 25. As shown also by FIG. 4, the housing 2 has, adjacent to the starter device 8, a multiplicity of cooling air openings 29. Via the cooling air openings 29, dirt deposits such as chips, dust or the like can also be sucked up during operation. Because of the peripheral wall 51, the starter device 8 is largely protected from dirt deposits. The peripheral wall 51 is supported by radially outward projecting reinforcing ribs 30.

Figure 5:
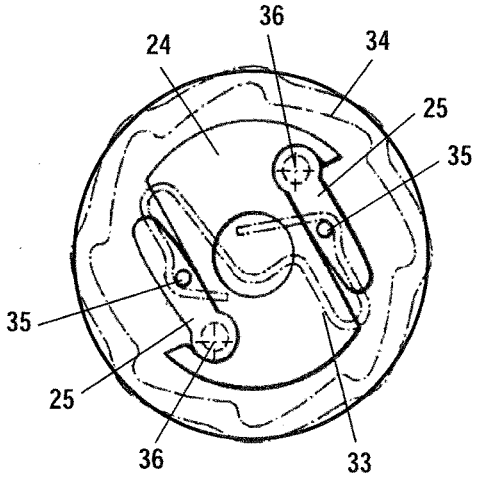
FIG. 5 is a schematic of the coupling means of the starter device of FIGS. 3 and 4.

FIG. 5 shows the arrangement of the actuating lugs 35 on a spring clip 33 fixed onto the bearing shaft 32. In addition, a cam contour 34 of the fan wheel 9, with which the pawls 25 cooperate during the starter process, is shown schematically. When the starter rope is pulled, the entrainer 24 rotates, in FIG. 5, in the clockwise direction. The actuating lugs 35 thereby move outwards in the spring clip 33 held by friction on the bearing shaft 32. In this way, the pawls 25 are pivoted outward about their pivot axes 36. In the outwardly pivoted position, the free ends of the pawls 25 enter into engagement with the cam contour 34 and thereby couple the entrainer 24 in a rotationally secure manner to the fan wheel 9 and the crankshaft 13 so as to rotate therewith. When the starter rope is retracted due to the return spring 17, the entrainer 24 rotates in FIG. 5 anti-clockwise. The pawls 25 are thereby pivoted back into the position shown in FIG. 5 due to the actuating lugs 35 being directed inward in the spring clip 33.

Figure 6:
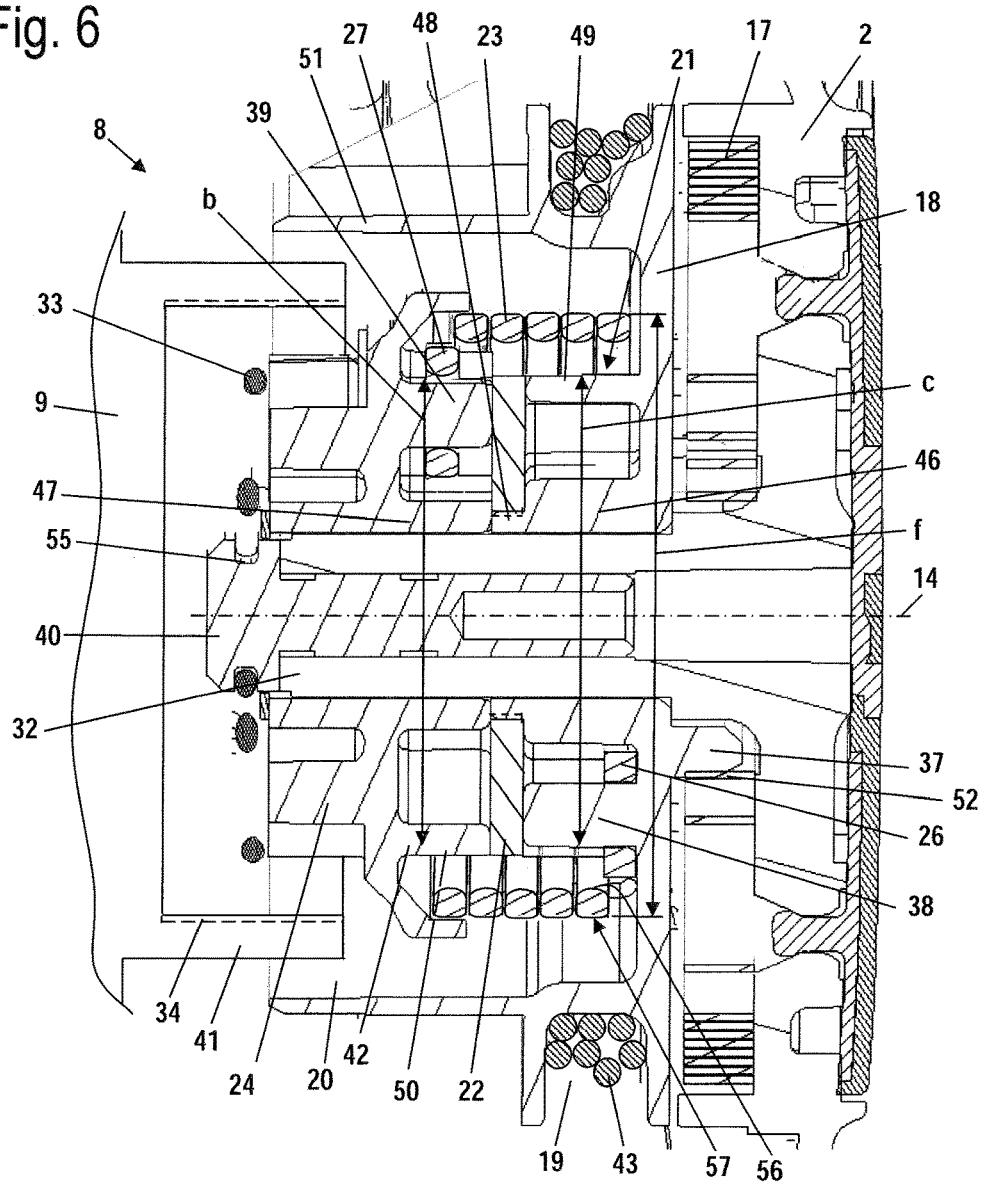
FIG. 6 is a schematic through the starter device.

The assembly of the starter device 8 is shown in detail in FIG. 6. The bearing shaft 32 is fixed in the housing 2. The bearing shaft 32 can, for example, be injection molded onto the housing 2. The bearing shaft 32 includes a retaining bolt 40, which has a groove 55 for accommodating the spring clip 33. The rope pulley 18 has a lug 37, which engages in the inner end 52 of the return spring 17 and thereby provides a rotationally secure connection between the inner end 52 of the return spring and the rope pulley 18. In FIG. 6, a pull rope 43 is shown schematically in the groove 19 of the rope pulley 18. Advantageously, one end of the pull rope 43 is held fixedly on the rope pulley 18, and the other end is held on the starter handle 7 (FIG. 1).

The stud 21 of the rope pulley 18 has an inner region 46, which is journalled on the bearing shaft 32, and an outer region 49, on whose outer periphery the damper spring 23 is mounted. The outer region 49 has an outer diameter (c), which in the embodiment shown corresponds to the outer diameter (a) of the disc 22 (FIG. 3). In the embodiment shown, the inner region 46 of the stud 21 has a shoulder 48, on which the disc 22 is mounted.

The entrainer 24 has a stud 42, which projects in the direction of the rope pulley 18. The stud 42 has an outer region 50, on whose outer periphery the damper spring 23 is mounted. The stud 42 has an inner region 47, which serves for the rotatable mounting of the entrainer 24 on the bearing shaft 32. Also, the inner region 47 of stud 42 lies with its end against the inner region 46 of the stud 21 adjacent to the outer periphery of the bearing shaft 32 in the embodiment shown. The stud 42 can also bear against the disc 22, which for its part bears against the stud 21 of the rope pulley 18. The bearing contact can here be provided against the inner regions (47, 46) or the outer regions (49, 50). As FIG. 6 also shows, the stud 42 has a wall portion 39, on which the second end 27 of the damper spring 23 is hooked into. The outer region 50 of the stud 42 has an outer diameter (b). Advantageously, the outer diameter (b) roughly corresponds to the outer diameter (c) of the outer region 49 of the stud 21 and to the outer diameter (a) of the disc 22 (FIG. 3).

The damper spring 23 has a radially inner side 56 referred to the rotational axis 14. This inner side 56 lies facing the studs 21 and 42. The damper spring 23 also has radially outermost outer side 57, which lies facing the peripheral wall 51 of the receiving space 20. As shown by FIG. 6, the cross section of the spring wire of the damper spring 23 is configured such that it is rounded off on the inner side 56. On the outer side 57, the cross section has a straight region. The damper spring 23 has a coil diameter (f), which corresponds to the outer diameter of the damper spring 23.

In FIG. 6, the fan wheel 9 is also shown schematically. The fan wheel 9 has a rim 41, which is of roughly cylindrical configuration, which, between the peripheral wall 51 and the entrainer 24, engages in the receiving space 20, and on the inner side of which is configured the cam contour 34.

During the starting operation, the damper spring 23 is tensioned when the pull rope 43 is pulled. The inner side 56 of the damper spring 23 can here be pulled as far as it will go onto the studs 21 and 42. If the damper spring 23 is pulled to the limit, then, upon further pulling on the pull rope 43, the tensile force is transmitted to the crankshaft 13 directly via the coupling device formed by the pawls 25 and the cam contour 34. If the damper spring 23 is not pulled to the limit, then the force of the damper spring 23 and the force applied to the pull rope 43 by the operator act jointly on the crankshaft 13.

Figure 7:
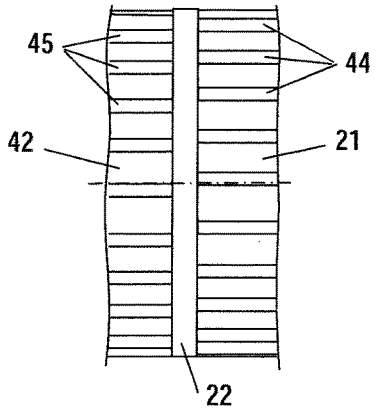
FIG. 7 is a schematic side elevation view of the studs of the starter device.

For the avoidance of dirt deposits, the studs 21 and 42 have, on their outer side, a multiplicity of depressions (44, 45), as shown schematically in FIG. 7. The depressions (44, 45) can be configured, for instance, as grooves running parallel to the rotational axis 14.

The damper spring 23 is wound from spring wire 58. FIG. 8 shows the cross section of the spring wire 58 of the damper spring 23 in detail. FIG. 8 here shows a section through the spring wire in a plane containing the rotational axis 14. In this section plane, the cross section of the spring wire 58 has a thickness (d), which is measured perpendicular to the rotational axis 14 (FIG. 5), and a width (e), which is measured parallel to the rotational axis 14. On the inner side 56, the cross section of the spring wire 58 runs in a radius (r) which is greater than half the width (e). Hence the cross section of the spring wire 58 on the inner side 56 is flatter compared with a damper spring of circular cross section. On its outer side 57, the spring wire 58 has a portion 61, in which the cross section runs straight. The damper spring 23 is accordingly configured flattened on its outer side 57. The straight portion 61 here extends over at least 30% of the width (e). In the embodiment shown, the straight portion 61 extends over approximately half the width (e). In the straight portion 61, the outer side 57 here runs parallel to the rotational axis 14. The spring wire 58 has transverse sides 59 and 60, which run roughly perpendicular to the rotational axis 14 (FIG. 6). The transverse sides 59 and 60 connect the inner side 56 to the outer side 57. In the embodiment shown, the transverse sides 59 and 60 are configured in mirror symmetry to each other. The transverse sides 59 and 60 have respective straight portions 62. The straight portion 62 advantageously extends over more than 30%, in particular over at least 50% of the thickness (d). The transverse sides 59 and 60 each extend over at a radius (s) into the outer side 57. The radius (s) is markedly less than the radius (r) and can measure, for instance, 60%, in particular roughly 50% of the radius (r). The radius (s) is here advantageously less than half the width (e), in particular less than 30% of the width (e).

Figure 9:
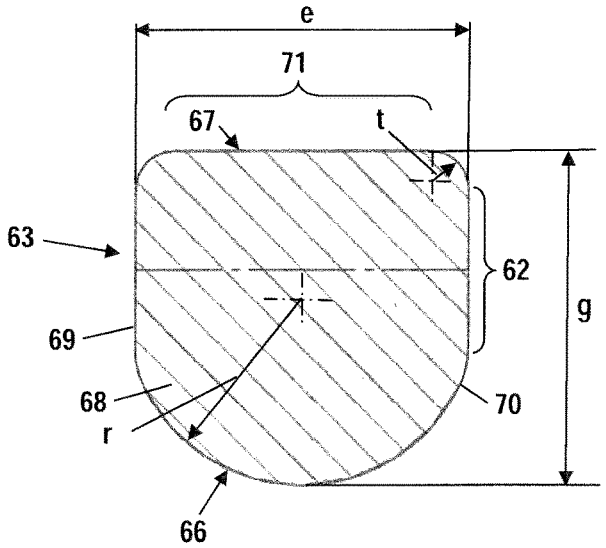

FIG. 9 shows an embodiment of a damper spring 63 having a spring wire 68, which is intended for use in a starter device 8. The configuration of the damper spring 63 substantially corresponds to that of the damper spring 23. The spring wire 68 has an inner side 66 and an outer side 67. On its inner side 66, the spring wire 68 runs with a radius (r). Also in the embodiment of FIG. 9, the radius (r) is greater than half the width (e) of the spring wire 68. The width (e) of the spring wire 68 here corresponds to the width (e) of the spring wire 58 from FIG. 8. The spring wire 68 has a thickness (g) which is less than the thickness (d) of the spring wire 58. The thickness (g) roughly corresponds to the width (e). On its outer side 67, the spring wire 68 has a straight portion 71, which extends over at least 30%, in particular over at least 50% of the width (e). In the embodiment shown, the straight portion 71 extends over more than 70% of the width (e). The outer side 67 passes with a radius (t) into transverse sides 69 and 70 of the spring wire 68. The radius (t) is markedly less than the radius (s) of the spring wire 58. The radius (t) advantageously measures less than 20%, in particular less than 15% of the width (e).

Figure 10:
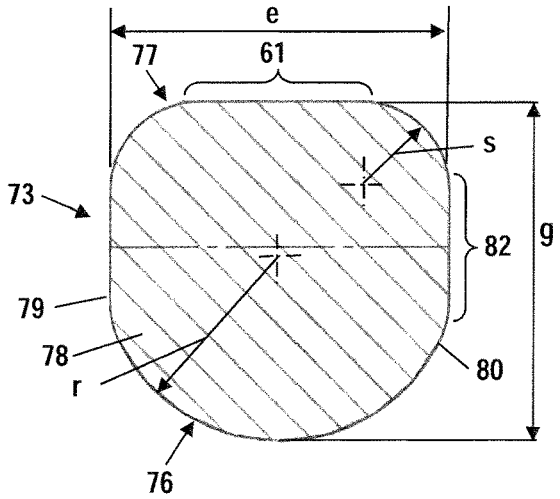

FIG. 10 shows an embodiment of a damper spring 73, which has a spring wire 78 and which is intended for use in a starter device 8. The spring wire 78 has an inner side 76 and an outer side 77, and transverse sides 79 and 80. The outer side 77 is configured in accordance with the outer side 57 of the spring wire 58 and has a straight portion 61, which passes with respective radii (s) into the transverse sides 79 and 80. The transverse sides 79 and 80 have respective straight portions 82, which run perpendicular to the rotational axis 14 (FIG. 6). The straight portion 82 advantageously extends over more than 30% of the thickness (g), in the embodiment shown, over roughly 50% of the thickness (g). The thickness (g) roughly corresponds to the width (e).

The damper spring 73 occupies the same structural space as a damper spring whose spring wire has a circular cross section of diameter corresponding to the width (e) or the thickness (g). In relation to such a damper spring of circular cross section, the spring wire 78 has however a larger section modulus against bending due to the material accumulation on the outer side 77. Due to the radius (r), which is greater than half the width (e), a flatter course of the rounding on the inner side 76 is additionally obtained. The damper spring 63 has, in relation to the damper spring 73, an increased section modulus against bending, and hence a higher spring constant due to the smaller radius (t) and the larger width of the straight portion 71.

The damper spring 23 too has a larger spring constant than the damper spring 73 due to the larger thickness (d). A desired spring constant can be set by an appropriate configuration of the cross-sectional form of the spring wire (58, 68, 78). Since the inner side (56, 66, 76) is of rounded-off configuration, the susceptibility to the formation of dirt on the inner side is reduced. As a result of the straight portions (62, 82) on the transverse sides (59, 60, 69, 70, 79, 80), adjacent coils, when they come to bear one against another, are in mutual contact not only linearly, but over a larger area. This prevents adjacent coils from sliding one over the other.

It is understood that the foregoing description is that of the preferred embodiments of the invention and that various changes and modifications may be made thereto without departing from the spirit and scope of the invention as defined in the appended claims.

What is claimed is:

1. A starter device for an internal combustion engine having a crankshaft and defining a rotational axis, the starter device comprising:

an actuator configured to permit rotation to be imparted thereto to start said engine;

an entrainer having at least one coupling unit for coupling to said crankshaft of said engine;

said entrainer and said actuator being rotatably mounted about said rotational axis;

a damper spring arranged between and operatively connecting said entrainer and said actuator to each other;

at least one stud having an outer periphery;

said damper spring being mounted on said outer periphery of said stud;

said damper spring being a hinge spring wound from spring wire and said spring wire being wound to include a plurality of turns;

said damper spring being tensioned when starting said internal combustion engine whereupon said damper spring becomes tight onto said stud;

said damper spring defining a section plane containing said rotational axis;

said spring wire having a cross section in said section plane;

in said cross section, said spring wire having an axially measured width (e) and a radially measured thickness (d, g, h);

in said cross section, said spring wire further having a radially inner-lying inner side and a radially outer-lying outer side;

in said cross section, said inner side of said spring wire being a rounded inner side with said rounded inner side being in contact engagement with said outer periphery of said stud;

at least a portion of said cross section running linearly at said outer side of said spring wire; and, said outer side of said spring wire lying exposed over at least half of said turns so as not to be in contact engagement with adjacent components.

2. The starter device of claim 1, wherein said inner side of said spring wire runs in a through radius (r).

3. The starter device of claim 2, wherein said radius (r) of said inner side is greater than half of said width (e).

4. The starter device of claim 1, wherein said at least a portion of said cross section extends over at least 30% of said width (e).

5. The starter device of claim 1, wherein said spring wire has transverse sides running transversely to said rotational axis and said at least a portion of said cross section runs linearly at said transverse sides.

6. The starter device of claim 5, wherein said spring wire has respective transitions whereat said outer side runs into corresponding ones of said transverse sides with a radius (s, t).

7. The starter device of claim 6, wherein said radius (s, t) of said transitions is less than one quarter of said width (e) of said spring wire.

8. The starter device of claim 1, wherein said thickness (d, g, h) is at least as large as said width (e) of said spring wire.

9. The starter device of claim 1, wherein said stud is a first stud configured to be part of said actuator; and, said starter device further comprises a second stud configured to be part of said entrainer and said second stud has an outer periphery; and, said actuator and said entrainer are mounted so as to cause the respective outer peripheries thereof to conjointly accommodate said damper spring thereon.

10. The starter device of claim 1, wherein said damper spring defines an essentially constant turns diameter (f).

11. The starter device of claim 1, wherein said damper spring has first and second end segments bent over inwardly; and, said damper spring is held on said actuator with said first end segment and held on said entrainer with said second end segment.

12. The starter device of claim 1, wherein said at least one of said studs has depressions formed in the outer periphery thereof.

13. The starter device of claim 1, wherein said coupling unit includes at least one pawl pivotally mounted on said entrainer and a cam contour fixedly mounted on said crankshaft so as to rotate therewith; and, said pawl and said cam contour are configured to coact to couple said starter device to said crankshaft.

14. The starter device of claim 1, wherein said actuator is a rope pulley which is configured so as to permit rotation to be manually imparted thereto with a pull rope.

15. A handheld work apparatus comprising:

an internal combustion engine having a crankshaft and defining a rotational axis;

a starter device for said engine;

said starter device including: an actuator configured to permit rotation to be imparted thereto to start said engine; and, an entrainer having at least one coupling unit for coupling to said crankshaft of said engine;

said entrainer and said actuator being rotatably mounted about said rotational axis;

a damper spring arranged between and operatively connecting said entrainer and said actuator to each other;

said starter device further including at least one stud having an outer periphery;

said damper spring being mounted on said outer periphery of said stud;

said damper spring being a hinge spring wound from spring wire;

said damper spring defining a section plane containing said rotational axis;

said spring wire having a cross section in said section plane;

in said cross section, said spring wire having an axially measured width (e) and a radially measured thickness (d, g, h);

in said cross section, said spring wire further having a radially inner-lying inner side and a radially outer-lying outer side;

in said cross section, said inner side of said spring wire being a rounded inner side; and, at least a portion of said cross section running linearly at said outer side of said spring wire.

16. A starter device for an internal combustion engine having a crankshaft and defining a rotational axis, the starter device comprising:

an actuator configured to permit rotation to be imparted thereto to start said engine;

an entrainer having at least one coupling unit for coupling to said crankshaft of said engine;

said entrainer and said actuator being rotatably mounted about said rotational axis;

a damper spring arranged between and operatively connecting said entrainer and said actuator to each other;

at least one stud having an outer periphery;

said damper spring being mounted on said outer periphery of said stud;

said damper spring being a hinge spring wound from spring wire and said spring wire being wound to include a plurality of turns;

said damper spring defining a section plane containing said rotational axis;

said spring wire having a cross section in said section plane;

in said section plane, said spring wire having an axially measured width (e) and a radially measured thickness (d, g, h);

in said cross section, said spring wire further having a radially inner-lying inner side and a radially outer-lying outer side;

said damper spring being mounted between said entrainer and said actuator so as to cause the outer diameter of said damper spring to be reduced when said actuator is actuated by an operator with said outer-lying outer side of said spring wire being exposed over at least half of said turns and lying at a spacing away from adjacent components;

in said cross section, said inner side of said spring wire being a rounded inner side; and, at least a portion of said cross section running linearly at said outer side of said spring wire.

* * * * *